US009004183B2

(12) United States Patent
Fay

(10) Patent No.: US 9,004,183 B2
(45) Date of Patent: Apr. 14, 2015

(54) DROP IN COMPLETION METHOD

(75) Inventor: Peter J. Fay, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 597 days.

(21) Appl. No.: 13/236,917

(22) Filed: Sep. 20, 2011

(65) Prior Publication Data

US 2013/0068482 A1 Mar. 21, 2013

(51) Int. Cl.

| | |
|---|---|
| ***E21B 23/00*** | (2006.01) |
| ***E21B 23/04*** | (2006.01) |
| ***E21B 40/00*** | (2006.01) |
| ***E21B 43/10*** | (2006.01) |

(52) U.S. Cl.

CPC ..... *E21B 23/04* (2013.01); *E21B 40/00* (2013.01); *E21B 43/10* (2013.01)

(58) Field of Classification Search

CPC ..... E21B 40/00; E21B 43/10; E21B 17/08; E21B 17/02; E21B 23/01; E21B 23/04

USPC ..... 166/382, 216, 217, 380, 208, 209–211

See application file for complete search history.

(56) References Cited

U.S. PATENT DOCUMENTS

| | | | | |
|---|---|---|---|---|
| 3,255,821 | A * | 6/1966 | Curlet | 166/380 |
| 4,223,746 | A | 9/1980 | Tanguy et al. | |
| 4,658,902 | A | 4/1987 | Wesson et al. | |
| 4,679,669 | A | 7/1987 | Kalb et al. | |
| 4,693,317 | A | 9/1987 | Edwards et al. | |
| 4,932,471 | A | 6/1990 | Tucker et al. | |
| 5,083,623 | A | 1/1992 | Barrington | |
| 5,183,113 | A | 2/1993 | Leaney et al. | |
| 5,366,013 | A | 11/1994 | Edwards et al. | |
| 5,549,156 | A | 8/1996 | Borden | |
| 5,590,714 | A | 1/1997 | Van Steenwyk et al. | |
| 5,875,875 | A | 3/1999 | Knotts | |
| 6,109,355 | A | 8/2000 | Reid | |
| 6,454,012 | B1 | 9/2002 | Reid | |
| 6,708,761 | B2 | 3/2004 | George et al. | |
| 6,817,598 | B2 | 11/2004 | Parrott et al. | |
| 7,178,600 | B2 | 2/2007 | Luke et al. | |
| 7,296,638 | B2 | 11/2007 | Beach et al. | |
| 7,328,748 | B2 | 2/2008 | Giacomino | |
| 7,451,809 | B2 | 11/2008 | Noske et al. | |
| 7,779,907 | B2 * | 8/2010 | Wagner et al. | 166/169 |
| 2010/0126732 | A1 | 5/2010 | Myerley et al. | |

* cited by examiner

*Primary Examiner* — Jennifer H Gay
*Assistant Examiner* — George Gray
(74) *Attorney, Agent, or Firm* — Steve Rosenblatt

(57) ABSTRACT

A string is equipped with a braking device to regulate its speed into the wellbore through an existing tubular. When the targeted amount of overlap with an existing tubular is accomplished the two tubulars are then joined together. The braking system can take many forms such as externally mounted mechanisms that are speed responsive to vary the braking force. The inside of the tubular can have trapped gas to provide buoyancy and reduce the dropping speed. The braking can be accomplished hydraulically through regulated flow through the tubular or by a combination of a hydraulic and mechanical device. The momentum of the dropped string can also be controlled with a swage device that at the appropriate location lands on a taper and wedges or fuses itself to the surrounding tubular to gain support from the surrounding tubular.

22 Claims, 4 Drawing Sheets

DROP IN COMPLETION METHOD

FIELD OF THE INVENTION

The field of the invention is running tubular string into a wellbore and more particularly a method to rapidly deploy a string without a running string by dropping the string and securing the dropped string to an existing string in the wellbore.

BACKGROUND OF THE INVENTION

FIGS. 1-3 illustrate the typical way strings are run into a wellbore and secured to each other. FIG. 1 illustrates an upper wellbore 10 that has a tubular string such as casing 12 that is sealed in the wellbore with cement 14. A hanger/seal is illustrated generically as 16 since there may be situations with higher strings in the wellbore 10 that are above casing 12 or the casing 12 may be supported from a wellhead that is not shown. A subsequent tubular string 18 is assembled at the well surface and then further advanced into the lower wellbore 20 such that the upper end 22 overlaps with the lower end 24 of the casing 12. A running string 26 is releasably secured to the string 18 and the release occurs after a hanger/seal 28 is deployed to secure the string 18 to the casing 12. The running string is then pulled from the upper wellbore 10 as shown in FIG. 3.

The process described above requires time to assemble the string 26 to the length that string 18 will overlap at its upper end 22 with the lower end 24 of casing 12. Having secured the string 18 to the casing 12 the running sting then has to be raised and disassembled and racked near the rig at the surface. The assembly and disassembly time for the running string is the time that is desired to be saved with the present invention.

The method entails dropping a string into a wellbore through an existing string and controlling its speed in a variety of ways. Upon reaching the desired location the strings are secured to each other in a variety of ways for conducting further downhole completion or production operations. The time saved is the time normally used to assemble and pull the running string. Typically the weight of the string is used to advance it and a variety of speed control features can be used to regulate the rate of advance to the end destination which can be the hole bottom or at a desired level of overlap with the existing tubular to which the dropped string will be attached. A variety of attachment techniques are described.

In the past, braking systems have been designed to decelerate dropped objects so that they don't damage downhole components by striking them at high speeds. These devices are typically intended to make the falling object stop either as fast as possible or if there is interaction with a well feature then the intent is to stop the object as that feature is encountered before impact with a downhole tool such as a closed ball valve for example. Other designs expect impact and provide crushable leading ends to absorb the kinetic energy during rapid deceleration to minimize damage to downhole components. Some examples of the above are USP and Published Applications U.S. Pat. No. 7,779,907; 2010/0126732; U.S. Pat. Nos. 7,178,600; 7,328,748; 5,366,013; 6,109,355; 6,454,012; 7,451,809; 4,693,317; 5,083,623; 5,183,113; 5,875,875; 6,708,761; 6,817,598; 4,223,746; 4,658,902; 4,932,471; 4,679,669; 5,549,156; 5,590,714 and 7,296,638.

The present invention seeks to rapidly deploy a string as well as fixate the rapidly delivered string in a manner that will properly position the string to be secured and minimize pressure effects on the formation that can ensue from excessive string travel speed. Those skilled in the art will more readily appreciate the details of the preferred mode of the invention from the description below and the associated drawings while recognizing that the full scope of the invention is to be determined from the appended claims.

SUMMARY OF THE INVENTION

A string is equipped with a braking device to regulate its speed into the wellbore through an existing tubular. When the targeted amount of overlap with an existing tubular is accomplished the two tubulars are then joined together. The braking system can take many forms such as externally mounted mechanisms that are speed responsive to vary the braking force. The inside of the tubular can have trapped gas to provide buoyancy and reduce the dropping speed. The braking can be accomplished hydraulically through regulated flow through the tubular or by a combination of a hydraulic and mechanical device. The momentum of the dropped string can also be controlled with a swage device that at the appropriate location lands on a taper and wedges or fuses itself to the surrounding tubular to gain support from the surrounding tubular. A hanger/packer device can be associated with the falling string to set against the surrounding tubular when the desired depth is reached. Actuation can be with a variety of signals or timers, for example.

DETAILED DESCRIPTION OF THE PREFERRED EMBODIMENT

Figure 4:
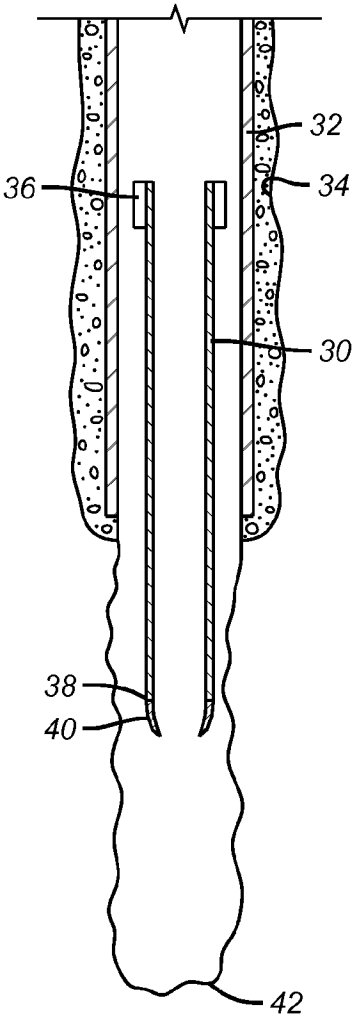
FIG. 4 shows a tubular string dropped through an existing string using the method of the present invention.
Figure 3:
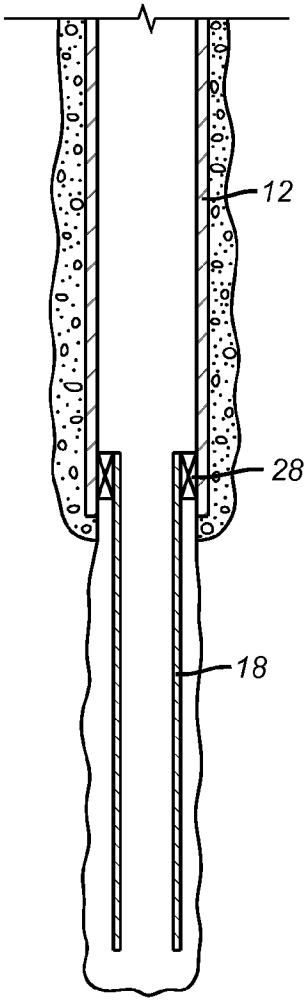
(PRIOR ART) FIG. 3
FIG. 3 is the view of FIG. 2 showing the second string attached to the casing and the running string pulled from the wellbore.
Figure 2:
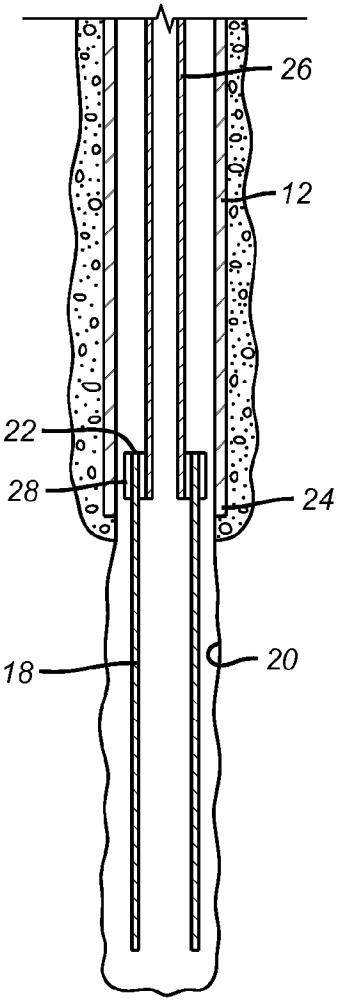
(PRIOR ART) FIG. 2
FIG. 2 is the view of FIG. 1 showing another string run to the lower end of the casing and in position for being joined to the casing.
Figure 1:
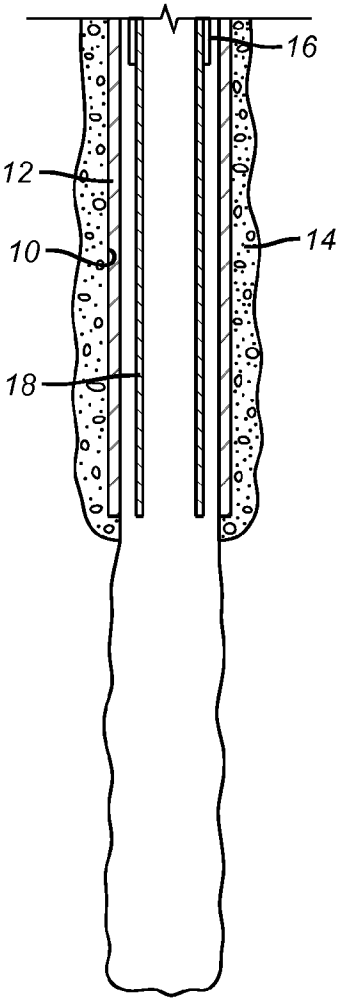
(PRIOR ART) FIG. 1
FIG. 1 shows cemented casing in a wellbore as is done in a manner known in the art.

FIG. 4 schematically illustrates the concept of the method of the present invention. A string 30 is dropped through an existing tubular 32 that is already in wellbore 34. Schematically illustrated as 36 is a braking device and a device that can secure the tubular 30 to the tubular 32. The braking and supports devices can be discrete or they can be integrated. Also shown schematically at a lower end 38 is a nose portion 40 that can facilitate travel of the string past joints or other wall irregularities in the existing string 32 or at transitions between strings if the dropping string 30 has to pass through more than a single size of tubular string that exists in the wellbore. Optionally, the nose 40 can have a crumple feature to absorb shocks such as when the falling string is designed to optionally land on the well bottom 42 before being secured to the tubular 32.

Figure 5:
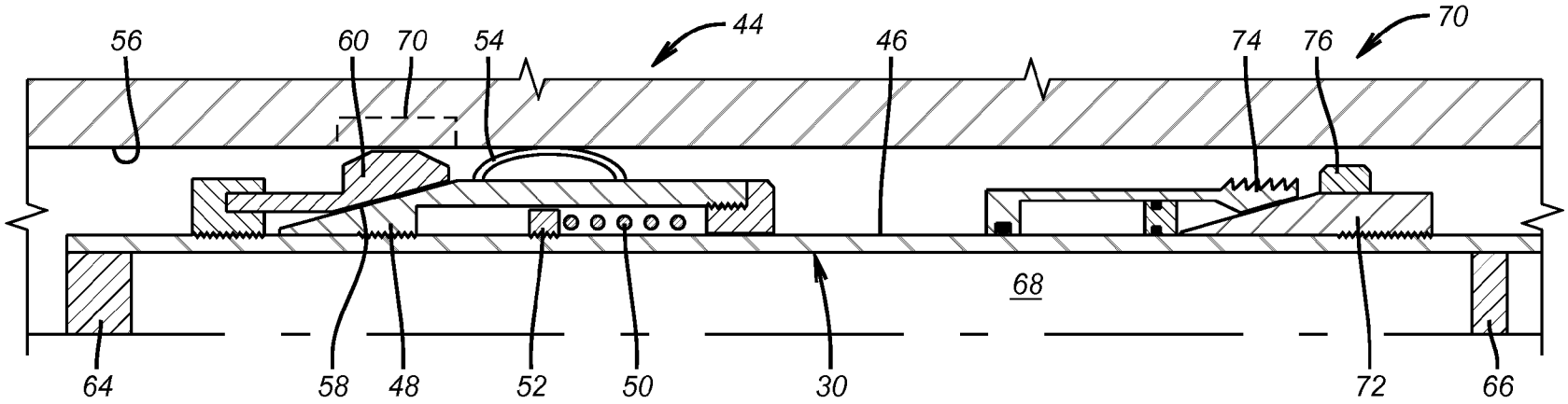
FIG. 5 shows a part of the falling string illustrating a braking assembly and a hanger/packer assembly that can be used to secure to an existing well tubular.

FIG. 5 shows one type of brake mechanism 44 on the outside wall 46 of the string 30 that is dropping. A wedge 48 is biased in a downhole direction by a spring 50 that bears on a stop 52. One or more flexible drag devices such as bow springs 54 are designed to extend into contact with the interior surface 56 of the existing string 32. The friction force that is generated from such sliding movement of the springs 54 overcomes the force of the spring or springs 50 so that the wedge 48 rides up under ramped surface 58 of brake sleeve or segment 60 that is secured to the dropping string 30 at ring 62. Sleeve or segment 60 flexes radially to contact surface 56 to slow the advance of the string 30. The top of the string 30 has a plug 64 and at the lower end there is another plug 66 to define a closed space 68 that holds air or another gas preferably at atmospheric pressure. The filling of the space 68 with gas adds to the buoyancy of the assembly and acts as a brake force against the weight of the string 30 falling under a gravitational force of its own weight. Once at the desired position the plugs 64 and 66 can be removed such as by exposure over time to well temperatures, or the addition of a material to the well to dissolve or otherwise remove these plugs or the use of anticipated well fluid properties with time exposure to get the result of plug removal so that further completion operations can take place through the string 30 or subsequent production or injection operations, for example.

As previously stated the string 30 can fall until the nose 40, if used, or the lower end 38 land on the well bottom 42 so that the hanger/packer assembly 70 is at the right location near the lower end of the existing tubular 32. Alternatively, the inner wall 56 can have a profile 70 that the brake assembly 44 can engage with sleeve or segment 60.

The hanger/packer assembly 70 is illustrated schematically and is actuated in several ways as schematically illustrated by arrow 72. One or more slips 74 and a seal assembly 76 can be actuated in a variety of known ways such as wellbore pressure, hydrostatic pressure, an adjacent processor that determines that it is time to actuate based on depth, acoustic signals, radio frequency signals, pressure release from a chamber or the like. The hanger packer assembly 70 and its mode of actuation is known in the art and incorporated into the method of the present invention to accomplish the securing function of joining the dropped tubular 30 to the surrounding tubular 32.

Figure 6:
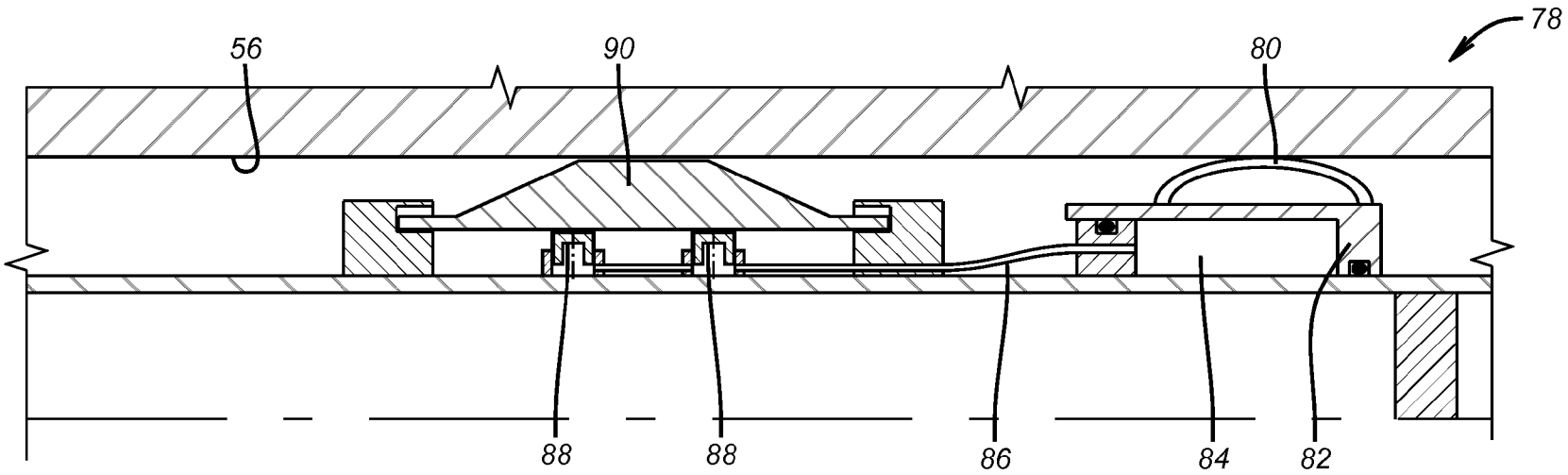
FIG. 6 shows an alternative design of a braking assembly than shown in FIG. 5 using a combination of mechanical and hydraulic operation.

FIG. 6 illustrates and alternative braking assembly 78. Here a dragging device such as a bow spring or springs 80 move a piston 82 to reduce the volume of chamber 84 and force out hydraulic fluid through line 86 to radially extend pistons 88 and in turn move out the brake shoe 90 against the inner wall 56 of the existing tubular 32.

Figure 7:
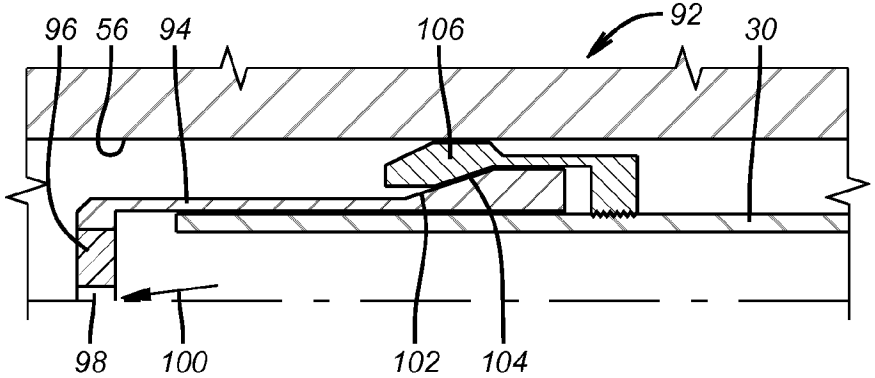
FIG. 7 shows an alternative braking device that relies on flow through the falling tubular to actuate the braking force.

FIG. 7 illustrates a braking device 92 for the dropped string 30 that uses a top sleeve 94 that has a plug 96 with an aperture 98. As the string 30 falls flow represented by arrow 100 goes through aperture 98 which puts an uphole force on the sleeve 94 that in turn drives ramp 102 along tapered surface 104 so that the brake shoe 106 is forcibly driven into wall 56 to slow the velocity of the dropping string 30.

Figure 8:
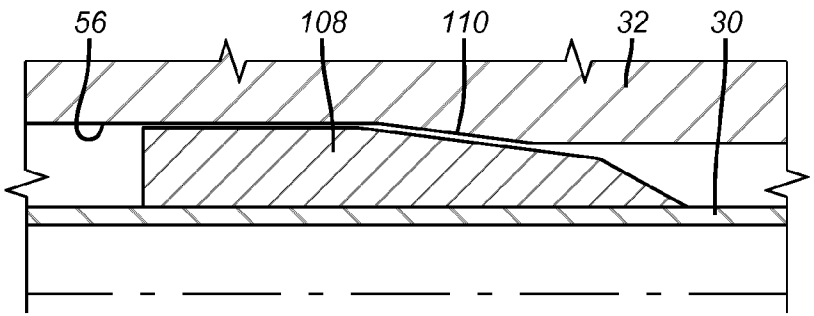
FIG. 8 shows a braking device that is a swage that elastically expands the exiting tubular wall as a braking device for the falling string.

FIG. 8 is another embodiment that is schematically represented as a swage member 108 that preferably elastically expands the inner wall 56 of the existing tubular 32 to get the desired braking force as the string 30 drops at a controlled rate. The inner wall 56 can have a profile 110 that is strong enough to stop the moving string when the swage member 108 comes into contact with it. Doing it this way will then use the hanger/seal assembly 78 as one way to secure the strings 30 and 32. Alternatively, the swage 108 can have a lock device to latch and seal in the profile 110 upon landing in it. In yet another alternative the interaction of the swage 108 as it enters the profile 110 can be used to fuse the two together from the heat generated from the momentum of the string 30 as it rapidly decelerates in the vicinity of the profile 110. Materials conducive to the fusion of surfaces can be used in the profile 110 and/or the outer face of the swage 108.

Figure 9:
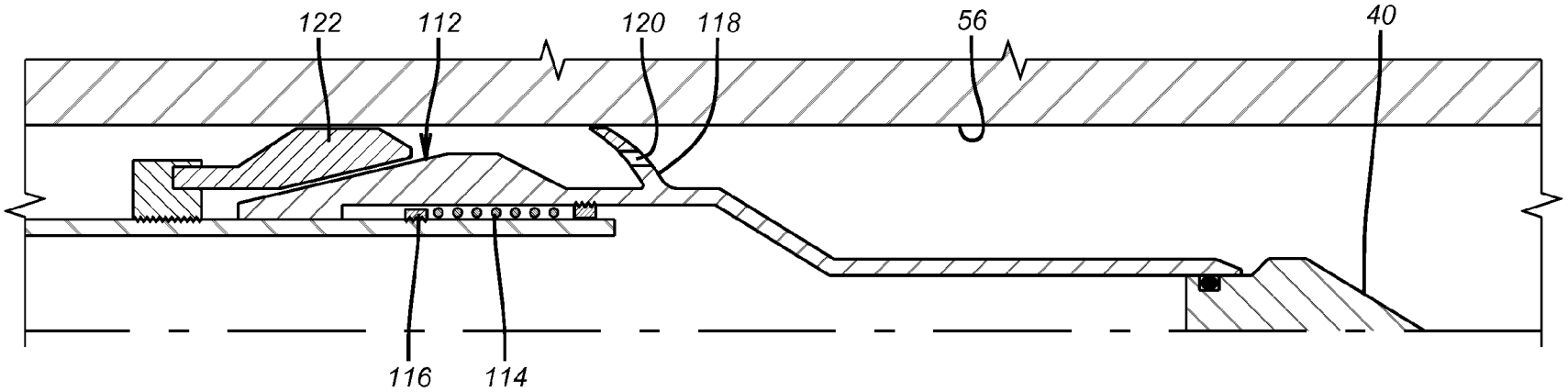
FIG. 9 shows a braking device that is a multi-part construction and responds to speed to apply more braking force in combination with a an annular barrier.

FIG. 9 illustrates the string 30 with a nose 40 connected to a ramp 112 that is biased downhole by spring 114 bearing on ring 116. Ramp 112 has a flexible annular barrier 118 that is designed to drag on wall 56 and has a port or ports 120 at are provided to attain the desired speed of descent. Alternatively the flow can go through the nose 40 if an opening is provided in it so that flow can pass through the string 18. Well fluid can also flex the barrier 118 so that flow can pass around the outside of the barrier 118 when it is flexed away from the wall 56. The uphole force on the ramp assembly 112 is related to the characteristics of the barrier 118 and the frictional force it generates. The higher the uphole force that is generated from the dropping of the string 30 the more braking force is applied by the shoe 122 against the surface 56 of the existing tubular 32.

Figure 10:
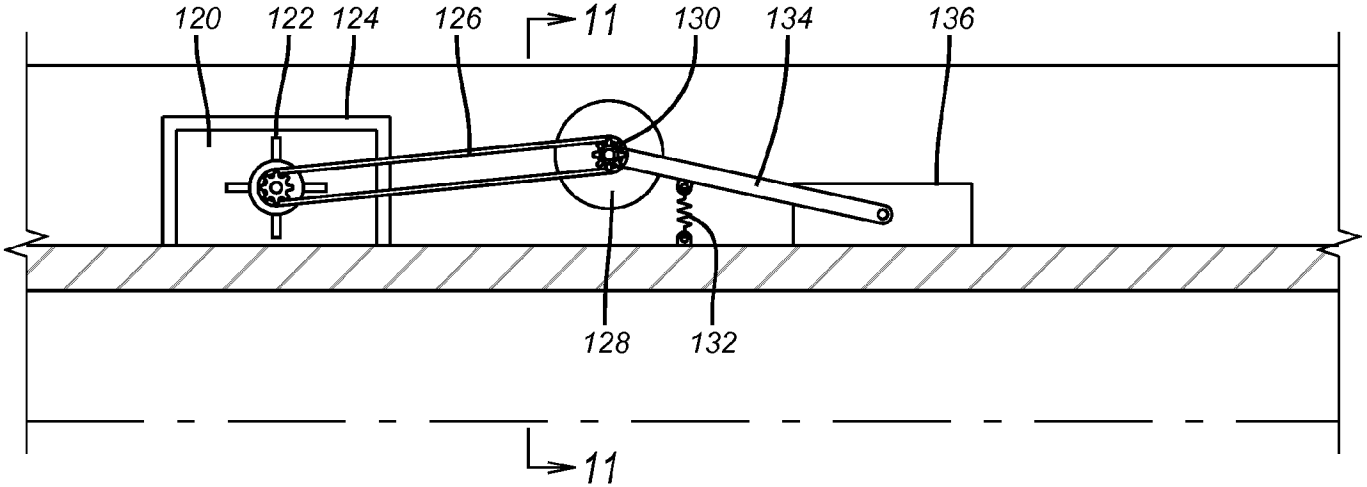
FIG. 10 is an alternative braking device using a wheel with a braking device.
Figure 11:
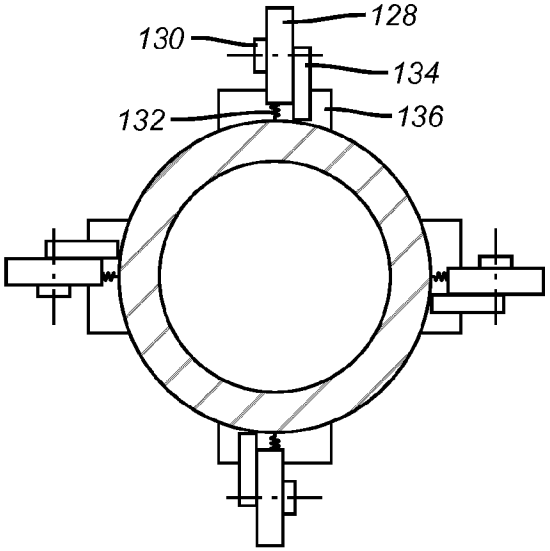
FIG. 11 is the view along lines 11-11 of FIG. 10.

Referring to FIGS. 10 and 11 a single assembly of four is shown in detail. A housing 136 supports a link 134 that is biased away from the string by a biasing member 132. At the other end of link 134 is a wheel 128 that rides on the inside wall of the string. The wheel 128 has a gear or pulley 130 on an axis thereof for connection to a drive system 126 that can be a belt or a chain. The drive system 126 links the rotation of the wheel 128 to a rotor 122. Rotation of rotor 122 is resisted by viscous drag between the rotor 122 and surrounding fluid. The surrounding fluid may be wellbore fluid or fluid enclosed in housing 124. The viscous drag thus creates a positive feedback system whereby the velocity of the string is limited by a ratio of drag coefficients to buoyant weight of the string. Those skilled in the art will appreciate that there are other variations to the above described method. Velocity control can also be with a processor and speed sensor for the falling string that can employ on board power such as a battery to actuate the braking device and to hold a predetermined speed of descent. The braking device can be configured to respond to velocity increases with increasing braking force. The buoyancy feature can be obtained with only a top plug 64 while omitting the bottom plug 66 leaving chamber 68 with an open bottom that could compress the gas in the chamber and somewhat reduce the buoyant force due to gas compression in chamber 68. The braking is designed for speed control to avoid raising pressure unduly on the formation as the string descends as is the goal when lowering a string on a running string. Stopping the string is done using the hole bottom or features in the existing sting through which the dropped string is moving. Once properly positioned, the hanger/packer can be deployed in a variety of ways. Alternatively, the two strings can be fused together as the dropped string reaches a stationary position using the heat from elastic deformation caused by the swage on the dropped string regulating its speed with the resistance of the elastic deformation of the swage associated with the dropped string. The leading end of the dropped string can have a tapered nose to ease passage of the string over irregularities in one or more existing strings or at size transitions between or among strings. The nose can have a crumple feature that can collapse if the string is allowed to drop to the hole bottom.

The above description is illustrative of the preferred embodiment and many modifications may be made by those skilled in the art without departing from the invention whose scope is to be determined from the literal and equivalent scope of the claims below.

I claim:

1. A method of delivering and securing a tubular string at a subterranean location, comprising:

dropping an assembled multi-component pressure conducting first tubular string through an existing string such that a leading end of said first tubular extends beyond a lower end of the existing string and off of a hole bottom to continue a pressure containing conduit comprising said existing and first tubular strings;

stopping said first tubular string as said first tubular string is dropping when at least a portion of said first tubular string overlaps said existing string and another portion of said first tubular string extends beyond said existing string and short of said hole bottom; and supporting said first tubular string from said existing string.

2. The method of claim 1, comprising:

regulating the speed of said first string as it falls.

3. The method of claim 1, comprising:

using an existing string profile to stop the travel of said first string.

4. The method of claim 1, comprising:

varying a braking force to said first tubular string with the velocity of said first tubular string.

5. The method of claim 4, comprising:

applying more braking force to said first string on an increase in the velocity of said first string.

6. The method of claim 5, comprising:

providing at least one wheel mounted to said first tubular to roll against said exiting tubular;

coupling said wheel to a velocity regulator.

7. The method of claim 6, comprising:

providing a rotor coupled to said wheel by a drive such that the speed of the wheel is controlled by friction of said rotor turning in a fluid.

8. The method of claim 7, comprising:

using a chain or belt as said drive.

9. The method of claim 1, comprising:

regulating the speed of said first string with a swage that elastically deforms the existing tubular.

10. The method of claim 9, comprising:

capturing said swage in a profile in said existing tubular.

11. The method of claim 1, comprising:

regulating the speed of said first string with fluid passing through said first string as said first string drops.

12. The method of claim 11, comprising:

driving a wedge using said flowing fluid through said first tubular;

actuating a brake pad radially against said existing tubular with said wedge.

13. The method of claim 1, comprising:

accomplishing said supporting by fusing said first tubular to said existing tubular.

14. The method of claim 1, comprising:

accomplishing said supporting with at least one of a hanger and a packer.

15. The method of claim 14, comprising:

setting at least one of said hanger and said packer using a signal that comprises one of acoustic, radio frequency, time, temperature, well fluid property and first string velocity.

16. The method of claim 1, comprising:

providing a tapered nose on said first string leading end.

17. A method of delivering and securing a tubular string at a subterranean location, comprising:

dropping a first tubular string through an existing string;

stopping said first tubular string when at least a portion of said first tubular string overlaps said existing string; and supporting said first tubular string from said existing string;

providing an annular barrier on a movable portion of said first string to engage the existing string as said first string drops;

allowing flow through said barrier or through said first string to allow said first string to drop;

using force against said annular barrier to actuate a braking device mounted to said first string.

18. The method of claim 17, comprising:

using at least one packer cup as said annular barrier.

19. A method of delivering and securing a tubular string at a subterranean location, comprising:

dropping a first tubular string through an existing string;

stopping said first tubular string when at least a portion of said first tubular string overlaps said existing string; and supporting said first tubular string from said existing string;

regulating the speed of said first string using friction force on a braking device that drags on the existing tubular.

20. The method of claim 19, comprising:

moving a wedge member with said friction force against a brake pad for said braking.

21. The method of claim 20, comprising:

moving said wedge member axially against a bias force to cam said brake pad radially against said existing tubular.

22. The method of claim 19, comprising:

building hydraulic pressure with said friction force;

actuating a brake pad with a piston actuated by said hydraulic pressure.

* * * * *